US009003608B2

(12) United States Patent
Fano

(10) Patent No.: US 9,003,608 B2
(45) Date of Patent: Apr. 14, 2015

(54) WORKING ASSEMBLY WITH A COOLING SYSTEM, FOR A MACHINE FOR OPENING FIBERS, IN PARTICULAR A CARDING MACHINE

(75) Inventor: Marco Fano, Moncalieri (IT)

(73) Assignee: Hi Tech Textile Holding GmbH, Leonding (AT)

( * ) Notice: Subject to any disclaimer, the term of this patent is extended or adjusted under 35 U.S.C. 154(b) by 0 days.

(21) Appl. No.: 14/000,465

(22) PCT Filed: Feb. 24, 2012

(86) PCT No.: PCT/EP2012/053155

§ 371 (c)(1), (2), (4) Date: Aug. 20, 2013

(87) PCT Pub. No.: WO2012/113903

PCT Pub. Date: Aug. 30, 2012

(65) Prior Publication Data

US 2013/0340206 A1 Dec. 26, 2013

(30) Foreign Application Priority Data

Feb. 25, 2011 (IT) ..... TO2011A0165

(51) Int. Cl.
*D01G 15/12* (2006.01)
*D01G 19/06* (2006.01)

(52) U.S. Cl.
CPC ..... *D01G 15/12* (2013.01); *D01G 19/06* (2013.01)

(58) Field of Classification Search
CPC ..... D01G 15/12; D01G 15/16
USPC ..... 19/98, 112; 165/89, 90
See application file for complete search history.

(56) References Cited

U.S. PATENT DOCUMENTS

| | | | | |
|---|---|---|---|---|
| 4,499,632 | A * | 2/1985 | Varga | 19/98 |
| 5,920,961 | A * | 7/1999 | Hollingsworth | 19/100 |
| 6,874,202 | B2 * | 4/2005 | Pferdmenges et al. | 19/112 |
| 7,614,122 | B2 * | 11/2009 | Pferdmenges et al. | 19/112 |
| 8,006,476 | B2 * | 8/2011 | Hosel et al. | 57/308 |
| 2003/0110594 | A1 * | 6/2003 | Pferdmenges et al. | 19/98 |
| 2007/0006423 | A1 * | 1/2007 | Pferdmenges et al. | 19/98 |
| 2008/0236178 | A1 * | 10/2008 | Hosel et al. | 62/186 |
| 2009/0200114 | A1 * | 8/2009 | Bagepalli et al. | 184/6.22 |

FOREIGN PATENT DOCUMENTS

| | | | |
|---|---|---|---|
| EP | 0 077 166 | A1 | 4/1983 |
| GB | 2 427 622 | A | 1/2007 |
| WO | 93/06273 | A1 | 4/1993 |

* cited by examiner

*Primary Examiner* — Shaun R Hurley
(74) *Attorney, Agent, or Firm* — McGlew and Tuttle, P.C.

(57) ABSTRACT

A working assembly (1) includes a rotatable hollow drum or cylinder (2) having a cylindrical wall (3) with ends having transverse header walls (4) with openings (16, 17), and with a longitudinal shaft (5). The external lateral surface of the cylindrical wall (3) has a clothing device intended to interact with the fibers being carded. First and second support uprights (6, 7) are fixed in operation, and adapted to support the ends of the shaft (5) of the drum or cylinder (2) for rotation about a preferably horizontal axis. The support uprights (6, 7) and the drum or cylinder (2) are configured and coupled with each other such as to define at least one fluid path for a flow of a refrigerating fluid, which extends through the openings (16, 17) and inside the drum or cylinder (2) and is adapted to cause cooling of the lateral cylindrical wall (3) thereof.

14 Claims, 4 Drawing Sheets

WORKING ASSEMBLY WITH A COOLING SYSTEM, FOR A MACHINE FOR OPENING FIBERS, IN PARTICULAR A CARDING MACHINE

CROSS REFERENCE TO RELATED APPLICATIONS

This application is a United States National Phase Application of International Application PCT/EP2012/053155 filed Feb. 24, 2012 and claims the benefit of priority under 35 U.S.C. §119 of Italian Patent Application TO2011A000165 filed Feb. 25, 2011, the entire contents of which are incorporated herein by reference.

FIELD OF THE INVENTION

The present invention relates to a working assembly for a fibers-opening machine for performing a carding and/or a combing process, particularly (though not necessarily) a carding machine. The invention is however equally applicable to machines for preparation to carding, such as fibers openers, volumetric feeders, web drawers, etc.

More specifically, the invention concerns a working assembly comprising a hollow drum or cylinder, rotatable in operation, having a cylindrical wall, at the ends of which there are coupled respective transverse header walls, and provided with a central longitudinal shaft; the external lateral surface of said cylindrical wall being provided with clothing means intended to interact with the fibers being treated; and first and second support uprights, which are fixed in operation, and adapted to support the ends of the shaft of the drum or cylinder for rotation about a preferably horizontal axis.

BACKGROUND OF THE INVENTION

The opening of fibers is a process consisting of progressively imposing a common longitudinal orientation to an aggregation of textile fibers which are fed as non-organized flocks, for obtaining, as a result, so-called fiber webs.

Examples of such machines for opening fibers are carding machines.

Carding machines comprise cylinders, the lateral wall of which is externally provided with clothings made, for instance, of continuous metal wires having a saw-tooth profile, said wires being wound to form spaced spirals or coils. In the carding process, the fibers to be carded are simultaneously "engaged" by clothings of two different drums or cylinders having different speeds and/or different directions of rotation.

The carding process involves the sliding of the fibers with friction onto the metal profile of the clothings of said drums or cylinders, with consequent generation of heat.

In recent years, carding machines have undergone remarkable technical improvements, which have brought to a progressive increase of their performances in terms of the quantity of fibers treated in unit time and quality of the finished products.

In particular, the increase of the quantity of fibers treated in unit time involves an increased carding action, with a consequent increase of the above-mentioned friction and the inherent production of heat in the areas where the fibers are carded.

The remarkable increase of heat development in the carding machines of the latest generations, determines, though to a different amount depending on the kind of fibers being treated, the following negative effects:

accelerated evaporation of the water which is normally added to the fibers in the treatments upstream of the carding machines, to permit correct carding; an increase of the percentage of water added upstream, for compensating the heavier evaporation is not possible, since it would involve further technical problems of another nature; and the achievement of operational temperatures which are close to the glass transition point or the melting point of the fibers; approaching these points involves a downgrading of the physical characteristics of the fibers and of the mechanical properties thereof (breaking load, traction strength, resiliency, and so on).

The above-mentioned negative effects act against, and therefore involve a limitation to, the possibility of working the fibers in the very large quantities desired, with the high quality standards required for the finished products.

SUMMARY OF THE INVENTION

An object of the present invention is to provide a working assembly of the above-defined kind, which allows to overcome the above-outlined negative effects.

The cylindrical wall of the rotating drum or cylinder is cooled by a flow of refrigerating fluid, preferably cooling air, which is passing through the inside of the hollow drum or cylinder, preferably with a substantially axial direction, along a fluid path whereby entering and leaving the drum or cylinder through respective openings in the header walls of the rotating drum being disposed around the central rotation axis. Inside the drum, the axial fluid flow may be directed by guiding means to the lateral cylindrical wall to cause cooling thereof. Due to the openings in the header walls, the volume and speed of the fluid flow may be very high, thus granting a great cooling effect. By selection of the number and size of these opening, the fluid flow rate can be adapted to meet the relevant requirements, in particular, of the carding machine and the carding process.

The support uprights and the drum or cylinder are configured and coupled with each other such as to define at least one fluid path for a flow of a refrigerating fluid between them and through the drum or cylinder. A distribution chamber between a support upright and an adjacent header wall may help to distribute the fluid flow between the stationary opening(s) in the support upright and the rotating openings in the header wall. The fluid flow is generated by a pumping device which can be controlled by an electronic control unit, preferably depending on the detected temperature of the cylindrical wall of the drum. A peripheral labyrinth sealing of the distribution chamber may help to prevent access of fibers to the sealing or the gap.

Further characteristics and advantages of the invention will become apparent from the following detailed description, made purely by way of a non-limiting example, with reference to the annexed drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
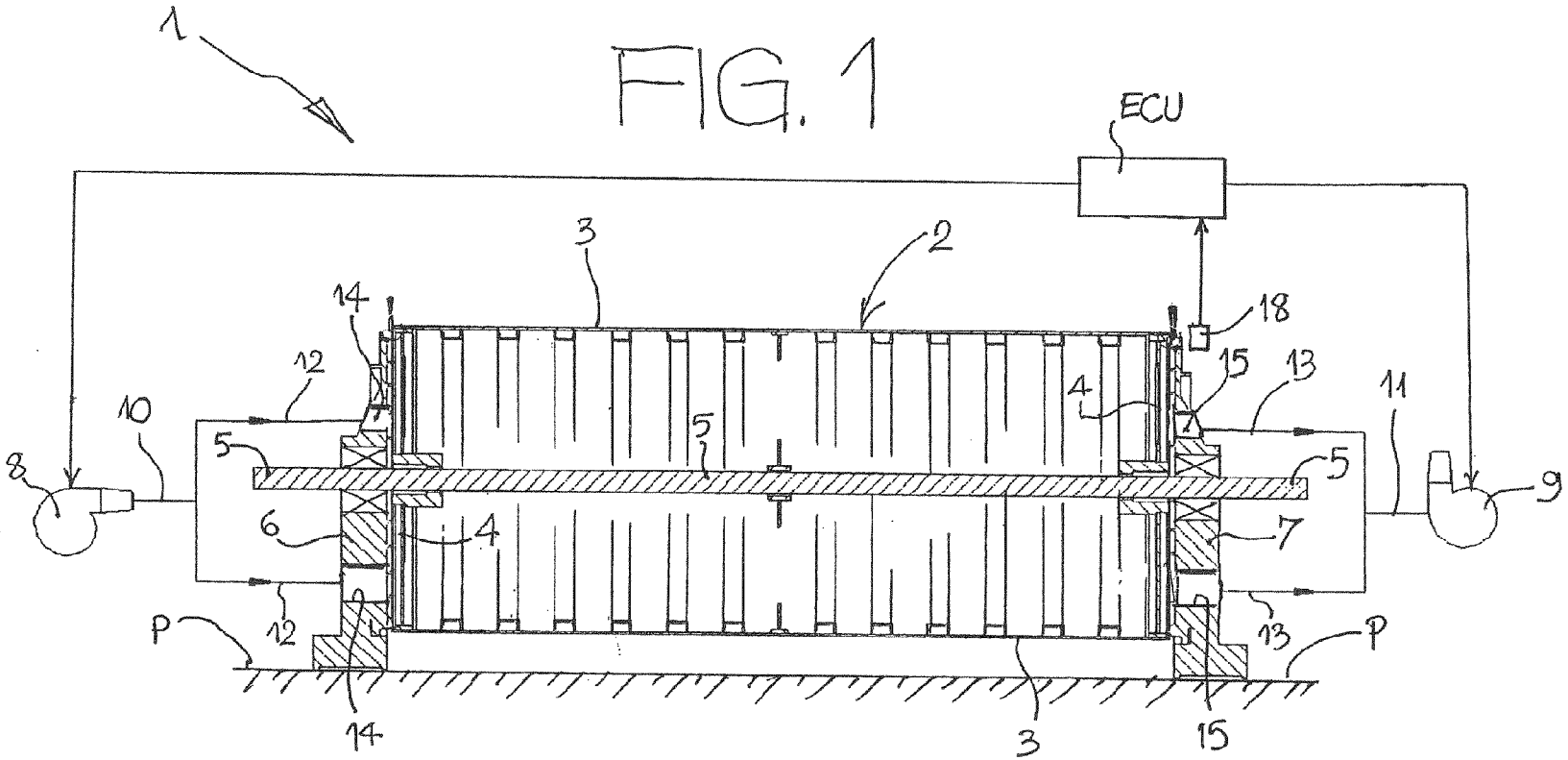
FIG. 1 is a diagrammatic representation, partially axially-sectioned, of a rotating working assembly for a machine for opening fibers according to the present invention.

Referring to the drawings in particular, the invention refers to a working assembly equipped with a cooling system and to a method of cooling to be used with such a working assembly.

In the drawings FIG. 1 is indicated as a whole a working group according to the present invention for a machine for opening fibers.

The working assembly 1 comprises a hollow drum or cylinder 2, rotatable and driven in operation. Depending on the type or carding machine and carding process, in particular Airlay carding, the rotational speed may be quite high, being in a range of about 500 rpm to 3.500 rpm for instance. Said drum or cylinder 2 has an external cylindrical wall indicated as a whole by 3, the ends of which are coupled to respective transverse header walls 4, facing each other (see also FIGS. 3 and 4).

In a manner know per se, and not shown, the external lateral surface of the cylindrical wall 3 of the drum 2 is provided with clothings intended to interact with fibers being treated.

The drum of cylinder 2 is provided with a central longitudinal shaft 5, which in the exemplary embodiment shown is of the through-passing type. The shaft 5 may be of a solid type.

Figure 4:
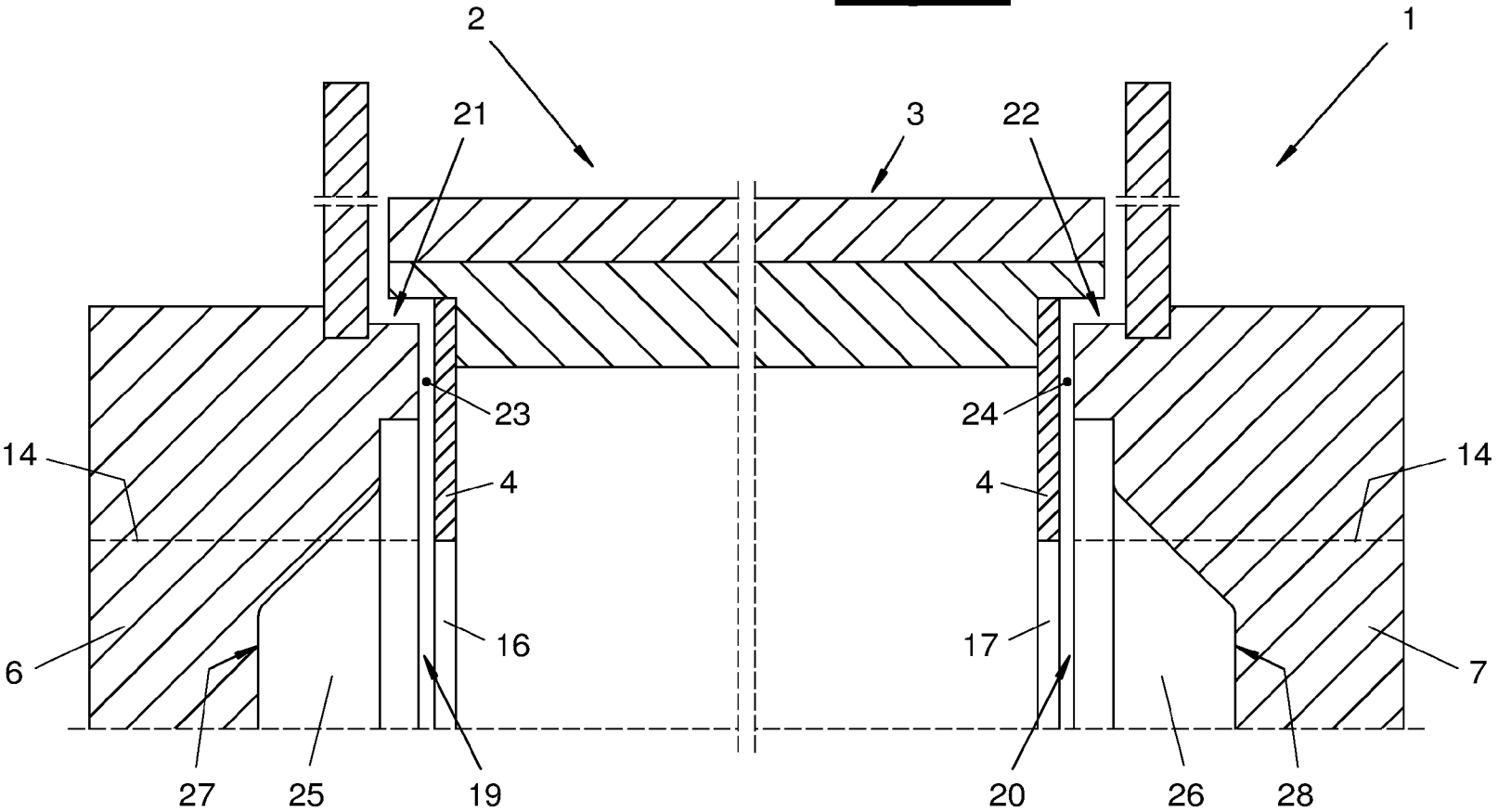
FIG. 4 is a partial sectional view, showing in a larger scale part of the working assembly according to the preceding Figures.

The ends of the shaft 5 extend outside the drum or cylinder 2, and are supported for rotation about a preferably horizontal axis by bearings within respective supporting uprights, indicated 6 and 7 in FIGS. 1 and 4.

The uprights 6 and 7 are, in a per se known manner, mounted in turn onto a robust support structure, such as the floor indicated P in FIG. 1.

The support uprights 6 and 7, and the drum or cylinder 2, are configured and coupled with each other such as to define at least one fluid path for a flow of a refrigerating fluid, which extends inside the drum, or cylinder 2, and is adapted to cause cooling of the lateral cylindrical wall 3 thereof. The fluid flow is at least partially directed axially along and in contact with the inner side of the said lateral cylindrical wall 3.

In the exemplary embodiment shown in the drawings, the refrigerating fluid utilized is a gaseous fluid, in particular, air. The fluid might however be another gaseous fluid, or a liquid.

The cooling system associated with the working assembly 1, and in particular with the drum or cylinder 2 thereof, conveniently comprises at least one electrically-controlled pumping device, coupled with said fluid path to induce therein said flow of refrigerating fluid.

In the embodiment diagrammatically shown in FIG. 1, said cooling system comprises a first electrically-controlled pumping device, such as an electric ventilator 8, coupled with said fluid path to "push" thereinto a flow of refrigerating fluid, toward the drum or cylinder 2. Furthermore, in the embodiment shown there is provided a second electrically controlled pumping device, such as further electric ventilator 9, equally coupled with said fluid path, for "drawing" a flow of refrigerating fluid from the fluid path into the drum or cylinder 2. There may be a combined pushing and drawing function or alternatively only one of them.

Still, with reference to FIG. 1, the illustrated embodiment said fluid path includes an inlet manifold 10, and an outlet manifold 11, connected each, through respective branch pipes 12 and 13, with respective pluralities of openings or passages 14, 15, predisposed in the first and the second support uprights 6, 7, respectively.

Figure 3:
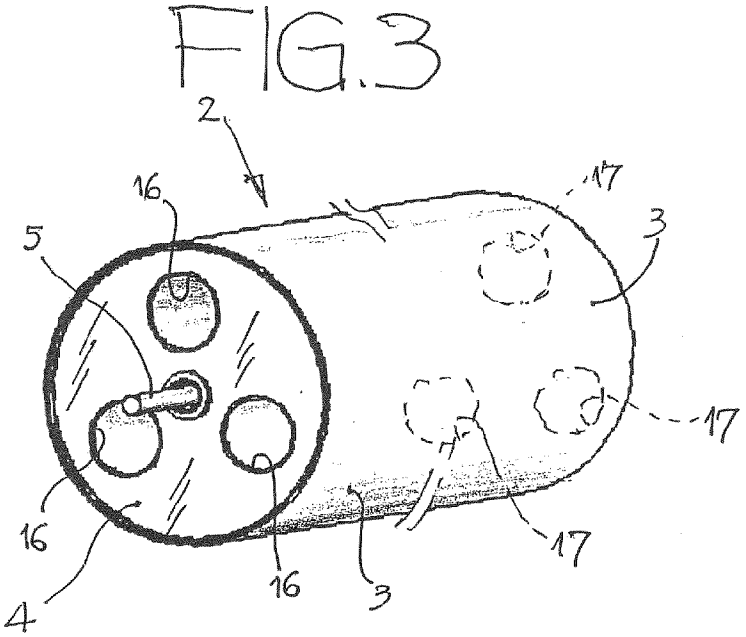
FIG. 3 is a partial perspective view of a drum or cylinder comprised in the working assembly according to the preceding Figures.
Figure 2:
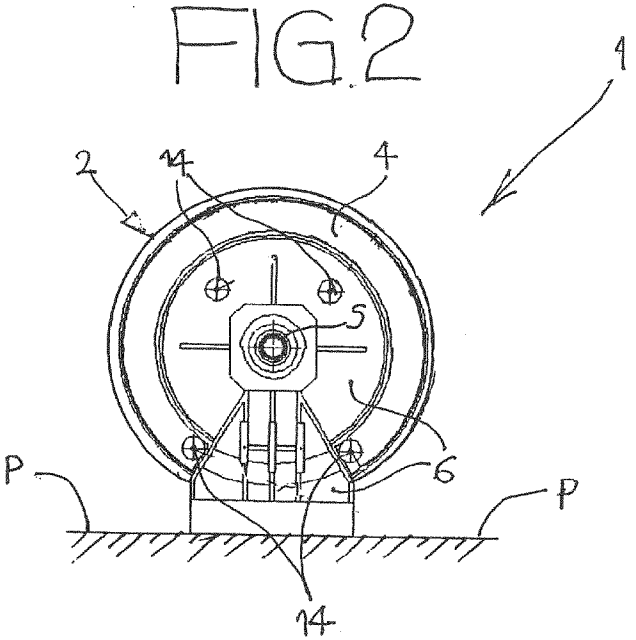
FIG. 2 is a partial side view of a the working assembly according to FIG. 1.

With reference to FIGS. 3 and 4, in the header walls 4 of the drum or cylinder 2 there are provided respective pluralities of openings 16 and 17, allowing the ingress and egress of the fluid flow to and from the internal region of the drum or cylinder 2. There are three or more respective openings 16, 17 in the header walls 4, for instance, being arranged and evenly distributed in at least one concentric circle around the central rotation axis. The number and size of these openings 16, 17 are selectable to tune the volume of the fluid flow. The number, size and arrangement of the openings or passages 14, 15 may be adapted in an appropriate manner.

In a first embodiment, these openings 16, 17 are positioned such that, when the drum or cylinder 2 rotates in the operation, they result periodically aligned with one stationary passage 14 or 15 of the corresponding support upright 6 or 7, bringing the internal region of said drum or cylinder 2 into communication with the inlet manifold 10 and the outlet manifold 11.

Another embodiment shown in FIG. 4 provides a distribution chamber 19, 20 for the fluid flow, located within axial the fluid path on one or both sides of the drum or cylinder 2 between the respective header wall 4 and the adjacent wall 27, 28 of the corresponding support upright 6,7. The plurality of respective openings 14, 15, 16, 17 within the walls 4, 27,28 are in permanent communication with the distribution chamber 19,20, and whereby with one another. The respective adjacent walls 4, 27, 28 are aligned, preferably in parallel relationship, and spaced in axial direction by a gap 23, 24 constituting a distribution chamber 19,20.

At least one of these adjacent walls 4, 27, 28 may be provided with a circular recess 25, 26 increasing the lateral dimension of the gap 23, 24 and the distribution chamber 19, 20. The radial width of the substantially cylindrical recess 25, 26 extends over the said plurality of respective openings 14, 15, 16, 17, creating a distribution chamber 19,20 with an increased volume ensuring a continuous flow of the refrigerating fluid between the rotating respective openings 16, 17 in the header wall 4, and the stationary openings or passages 14, 15 in the adjacent support upright 6,7, even if those openings are located on different diameters and are not aligned at any moment during the rotation of the drum. Said distribution chamber 19, 20 is sealed at the periphery by a sealing 21, 22, preferably a non-contact labyrinth sealing. The labyrinth sealing allows a leak through a small radial passageway on the periphery of the drum, preventing fibers from entering due to the pressure inside the distribution chambers.

A suitably phased activation of the electric ventilators 8 and 9 is capable of inducing a flow of cooling air inside the drum or cylinder 2, in an axial direction, which "licks" the walls thereof, and, in particular, the lateral cylindrical wall of said drum 2, thus progressively lowering the temperature thereof in the operation.

Inside the drum or cylinder 2 the shaft 5 may be provided with guiding means 29, for instance, radial vanes, leading the flow of cooling air towards the cylindrical wall 3 and improving the heat transfer in the drum. Said guiding means or vanes may create a turbulent fluid flow. They are not shown in FIG. 1.

Figure 5:
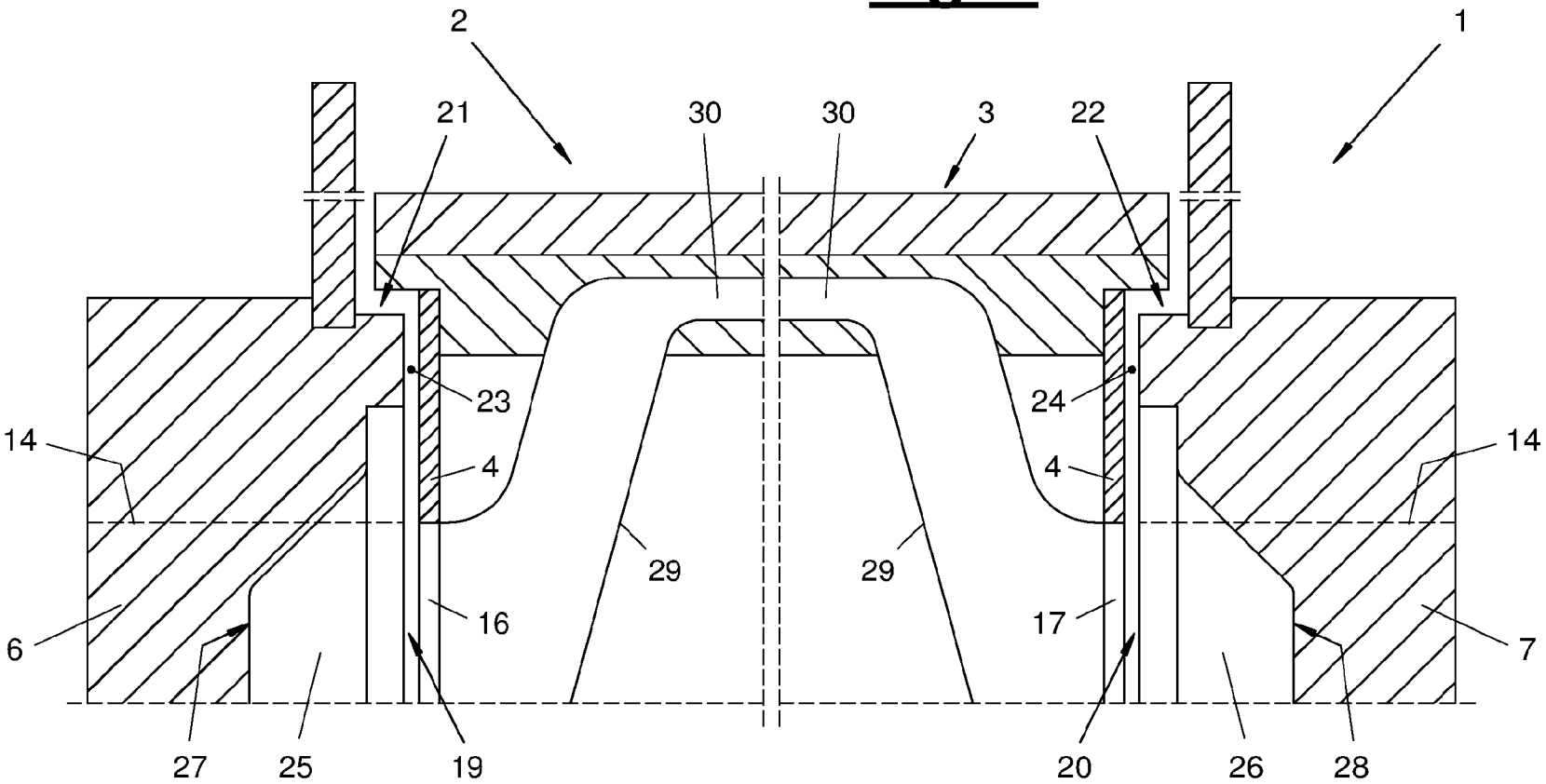
FIG. 5 is a partial sectional view, showing a modification of FIG. 4.

FIG. 5 shows another embodiment of the drum or cylinder 2 and the lateral wall 3 thereof. The lateral wall 3 is hollow or shaped at the inside, having one or more integrated or mounted axial and/or circumferential and/or spiral channels (30) to guide the fluid flow along the wall 3 for appropriate cooling. Guiding means 29, for instance hoses, channels or vanes, are mounted on the inside of the respective header walls 4 to guide the incoming fluid flow from the respective openings 16 to the one end of the channel(s) 30 within or at the lateral wall 3. At the other end of the channel(s) 30 they guide the leaving fluid flow to the openings 17 for egress thereof. The guiding means 29 may collect and/or distribute the incoming and/or leaving fluid flow in an appropriate way. They may constitute another distribution chamber at the inner side of the respective header wall (4).

Conveniently, an electronic control unit (ECU) is associated with a pumping device, in particular with the electric ventilators 8 and 9, said unit being predisposed to control the speed thereof and, consequently, the flow-rate of the air flow inside the drum or cylinder 2, as a function of the temperature of said drum or cylinder, in particular of the lateral wall 3 thereof, detected for instance by means of a temperature probe 18 (FIG. 1). The fluid or air flow may be kept constant or may be pulsing.

Although in the present description, and in the annexed drawings, reference is made to a single drum or cylinder, the invention can be also conveniently used on each of the drums or cylinders of a carding machine or, in general, of a machine for opening and/or blending fibers.

As it has already been mentioned previously, instead of a gaseous fluid, a cooling liquid could be used, of course with the necessary measures for providing the necessary seals.

Naturally, the principle of the invention remaining the same, the forms and particulars of embodiment may be widely varied with respect to what has been described and illustrated by way of a non-limiting example, without departing from the scope of the invention as defined in the annexed claims. While specific embodiments of the invention have been shown and described in detail to illustrate the application of the principles of the invention, it will be understood that the invention may be embodied otherwise without departing from such principles.

The invention claimed is:

1. A working assembly for machines for opening fibers and/or preparation to carding, comprising:

a hollow drum or cylinder, rotatable in operation, having a cylindrical wall at the ends of which there are coupled respective transverse header walls, and provided with a central longitudinal shaft;

clothing means, the external lateral surface of said cylindrical wall being provided with the clothing means intended to interact with the fibers being carded;

first and second support uprights which are fixed in operation, and adapted to support the ends of the shaft of the drum or cylinder for rotation about an axis;

a cooling system to cause cooling of the lateral cylindrical wall of the drum or cylinder, wherein:

the header walls are provided with respective openings;

the support uprights and the drum or cylinder are configured and coupled with each other such as to define at least one fluid path for a flow of a refrigerating fluid, which extends through the openings and inside of the drum or cylinder and is adapted to cause cooling of the lateral cylindrical wall thereof; and at least one pumping device coupled with said fluid path and adapted to induce therein said flow of refrigerating fluid, wherein the support uprights are provided with a plurality of respective openings or passages communicating with the plurality of corresponding openings of the adjacent header walls.

2. A working assembly according to claim 1 further comprising:

a distribution chamber provided in the fluid path between the header wall and an adjacent wall of the corresponding support upright, the plurality of respective openings communicating with the distribution chamber.

3. A working assembly according to claim 2, wherein a respective header wall and an adjacent wall of a corresponding support upright are aligned and spaced by a gap whereby constituting a distribution chamber.

4. A working assembly according to claim 2, wherein at least one of a header wall and an adjacent wall of a corresponding support upright is provided with a circular recess with a width extending over the said plurality of respective openings.

5. A working assembly according to claim 2, wherein a gap or distribution chamber is provided at the periphery thereof with a non contact labyrinth sealing.

6. A working assembly according to claim 1, further comprising a control unit associated with said at least one pumping device, and predisposed to modify the fluid flow throughput thereof.

7. A working assembly according to claim 1, wherein said at least one pumping device comprises:

a first electrically controlled pumping device coupled with said fluid path, for pushing a flow of said refrigerating fluid towards said fluid path in the drum or cylinder; and a second electrically controlled pumping device coupled with said fluid path, to draw a flow of said refrigerating fluid from said fluid path, into the drum or cylinder.

8. A working assembly according to claim 1, wherein said at least one pumping device is disposed outside the drum or cylinder.

9. A working assembly according to claim 1, wherein the refrigerating fluid is air.

10. A working assembly according to claim 9, wherein said at least one pumping device comprises an electric ventilator.

11. A working assembly according to claim 1, further comprising a guiding means including vanes or hoses, arranged inside of the drum or cylinder directing the fluid flow to the lateral wall thereof, having at least one channel for the fluid flow.

12. A working assembly according to claim 1, wherein said fluid path includes an inlet manifold and an outlet manifold, connected each with a respective plurality of openings or passages predisposed in the first and second support uprights, respectively.

13. A working assembly according to claim 12, wherein said plurality of openings in the respective walls of the drum or the cylinder are periodically brought to be facing with a passage of the corresponding support upright, to put the region inside the drum or cylinder in communication with said inlet and outlet manifolds.

14. A working assembly according to claim 1, wherein said refrigerating fluid is a liquid.

* * * * *